US011022121B2

(12) United States Patent
Nishikawa et al.

(10) Patent No.: US 11,022,121 B2
(45) Date of Patent: Jun. 1, 2021

(54) SCROLL COMPRESSOR

(71) Applicant: DAIKIN INDUSTRIES, LTD., Osaka (JP)

(72) Inventors: Sayumi Nishikawa, Osaka (JP); Yoshitomo Tsuka, Osaka (JP); Katsumi Katou, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/107,513

(22) Filed: Nov. 30, 2020

(65) Prior Publication Data

US 2021/0079916 A1 Mar. 18, 2021

Related U.S. Application Data

(63) Continuation of application No. PCT/JP2019/022413, filed on Jun. 5, 2019.

(30) Foreign Application Priority Data

Jul. 5, 2018 (JP) ..... JP2018-128032

(51) Int. Cl.
*F04C 29/02* (2006.01)
*F04C 18/02* (2006.01)
*F04C 23/00* (2006.01)

(52) U.S. Cl.
CPC ..... *F04C 29/028* (2013.01); *F04C 18/0215* (2013.01); *F04C 18/0253* (2013.01)

(58) Field of Classification Search
CPC ..... F04C 29/028; F04C 18/0215; F04C 18/0253; F04C 18/0246; F04C 18/02; F04C 23/008
See application file for complete search history.

(56) References Cited

U.S. PATENT DOCUMENTS 4,596,521 A * 6/1986 Murayama ..... F01C 1/0215 418/180
5,127,809 A 7/1992 Amata et al.
(Continued)

FOREIGN PATENT DOCUMENTS

JP 2-130284 A 5/1990
JP 3-242484 A 10/1991
(Continued)

OTHER PUBLICATIONS

English translation of WO-2016135865 by Espacenet Mar. 16, 2021.*
(Continued)

*Primary Examiner* — Deming Wan
(74) *Attorney, Agent, or Firm* — Global IP Counselors, LLP

(57) ABSTRACT

A compression mechanism of a scroll compressor has a back-pressure chamber defined on a back face of an end plate of a movable scroll. The compression mechanism has an annular space defined at an outer periphery of the end plate of the movable scroll. The movable scroll has a movable-side passage through which a compression chamber intermittently communicates with the back-pressure chamber in accordance with eccentric rotation of the movable scroll. The end plate of the movable scroll has a communication space through which the movable-side passage communicates with the annular space. The communication space includes first and second communication portions located forward and rearward of the movable-side passage in a direction of eccentric rotation, respectively. A first circumferential width of a first opening in the first communication portion is larger than a second circumferential width of a second opening in the second communication portion.

20 Claims, 9 Drawing Sheets

(56) References Cited

U.S. PATENT DOCUMENTS

| | | | | |
|---|---|---|---|---|
| 6,761,545 | B1 * | 7/2004 | Witham | F04C 18/0215 418/55.5 |
| 2012/0230854 | A1 | 9/2012 | Chikano et al. | |
| 2014/0234148 | A1 | 8/2014 | Takeda et al. | |
| 2016/0186754 | A1 * | 6/2016 | Cho | F04C 29/023 418/55.1 |
| 2016/0298626 | A1 | 10/2016 | Nishide | |

FOREIGN PATENT DOCUMENTS

| | | | | |
|---|---|---|---|---|
| JP | 4-76291 | A | 3/1992 | |
| JP | 2005-140067 | A | 6/2005 | |
| JP | 2014-125914 | A | 7/2011 | |
| JP | 2012-177301 | A | 9/2012 | |
| JP | 2015-105642 | A | 6/2015 | |
| WO | WO-2016135865 | A1 * | 9/2016 | F04C 18/02 |

OTHER PUBLICATIONS

International Search Report of corresponding PCT Application No. PCT/JP2019/022413 dated Aug. 20, 2019.
European Search Report of corresponding EP Application No. 19 83 0735.7 dated Nov. 30, 2020.
International Preliminary Report of corresponding PCT Application No. PCT/JP2019/022413 dated Jan. 14, 2021.

* cited by examiner

SCROLL COMPRESSOR

CROSS-REFERENCE TO RELATED APPLICATIONS

This is a continuation of International Application No. PCT/JP2019/022413 filed on Jun. 5, 2019, which claims priority to Japanese Patent Application No. 2018-128032 filed on Jul. 5, 2018. The entire disclosures of these applications are incorporated by reference herein.

BACKGROUND

Field of Invention

The present disclosure relates to a scroll compressor.

Background Information

JP 2015-105642 A discloses a scroll compressor. In the scroll compressor, a movable scroll is driven through a drive shaft to eccentrically rotate with respect to a fixed scroll. A refrigerant is thus compressed in a compression chamber defined between a wrap of the fixed scroll and a wrap of the movable scroll.

As disclosed in JP 2015-105642 A, the scroll compressor has an annular space defined at an outer periphery of an end plate of the movable scroll such that the end plate swirls in the annular space. A lubricating oil (an oil) is present in the annular space, and is fed to sliding portions in a compression mechanism. According to this configuration, when the movable scroll swirls (i.e., eccentrically rotates), the oil in the annular space is pressed against the outer peripheral face of the end plate. This results in increased stirring loss of the oil and increased power loss of a motor.

SUMMARY

The present disclosure is directed to suppressing an increase in power loss owing to eccentric rotation of an end plate of a movable scroll in an annular space.

An aspect of the present disclosure provides a scroll compressor including a compression mechanism that includes a movable scroll and a fixed scroll and has a compression chamber defined between the movable scroll and the fixed scroll, wherein

- the compression mechanism has a back-pressure chamber defined on a back face of an end plate of the movable scroll,
- the compression mechanism has an annular space defined at an outer periphery of the end plate of the movable scroll,
- the movable scroll has a movable-side passage through which the compression chamber intermittently communicates with the back-pressure chamber in accordance with eccentric rotation of the movable scroll,
- the end plate of the movable scroll has a communication space through which the movable-side passage communicates with the annular space,
- the communication space includes:
  - a first communication portion located forward of the movable-side passage in a direction of eccentric rotation; and
  - a second communication portion located rearward of the movable-side passage in the direction of eccentric rotation, and

- a circumferential width W1 of an opening in the first communication portion, the opening being open toward to the annular space, is larger than a circumferential width W2 of an opening in the second communication portion, the opening being open toward the annular space.

DETAILED DESCRIPTION OF EMBODIMENT(S)

Embodiment

Figure 1:
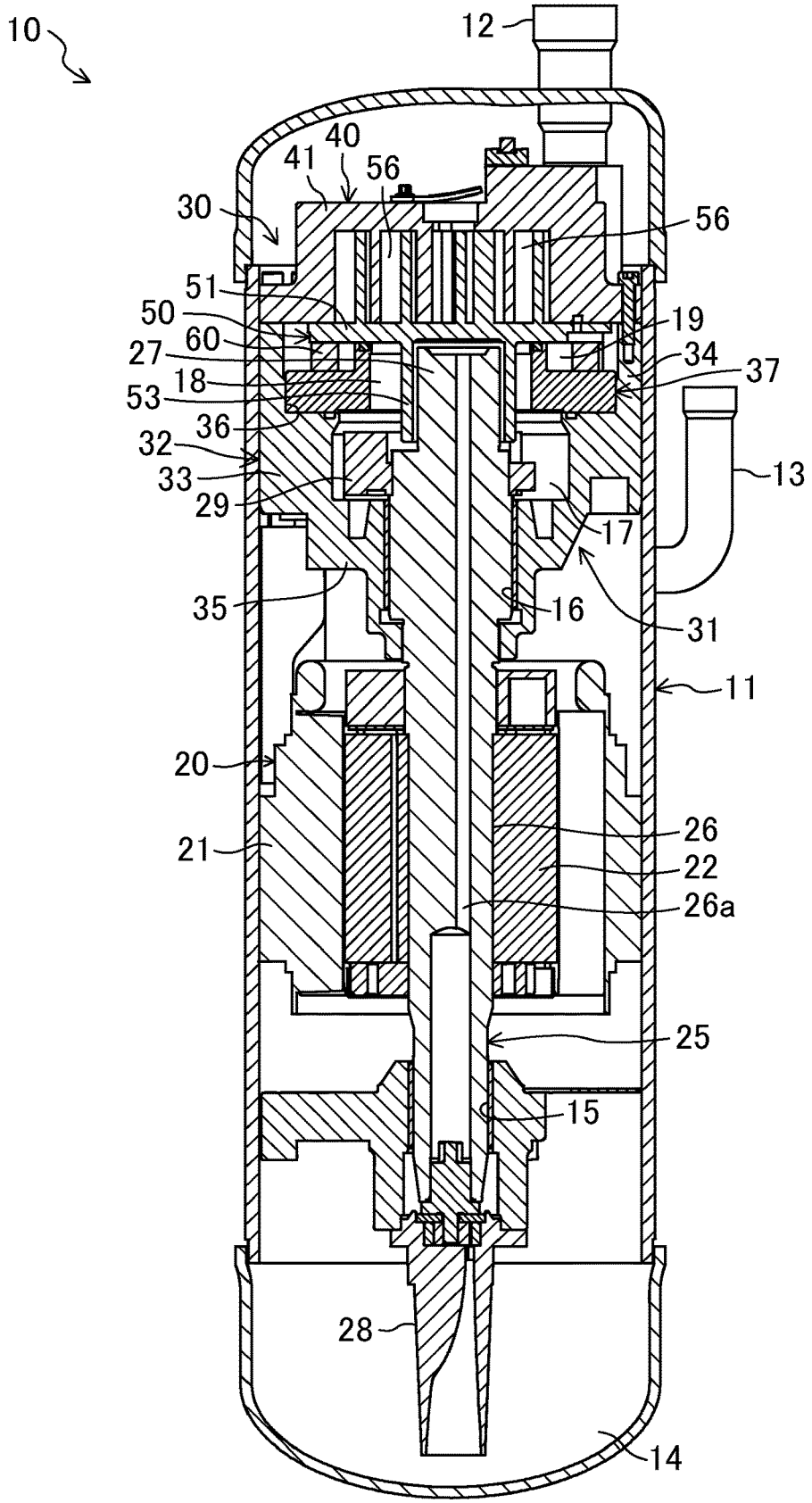
FIG. 1 is a longitudinal sectional view of a general configuration of a compressor according to an embodiment.

With reference to the drawings, a specific description will be given of a scroll compressor according to an embodiment (hereinafter, referred to as a compressor (10)). The compressor (10) is connected to, for example, a refrigerant circuit, and is configured to compress a refrigerant (a fluid) in the refrigerant circuit. The refrigerant circuit implements a refrigeration cycle. Specifically, the refrigerant circuit includes a condenser that condenses the refrigerant (the fluid) compressed by the compressor (10), a decompression mechanism that decompresses the refrigerant, and an evaporator that evaporates the refrigerant. Finally, the resultant refrigerant is sucked into the compressor (10). The compressor (10) includes a casing (11). The compressor (10) also includes a motor (20), a drive shaft (25), and a compression mechanism (30) each accommodated in the casing (11).

Casing

The casing (11) has the shape of a longitudinally elongated cylinder whose axial ends are closed. The casing (11) is a hermetic container filled with a high-pressure refrigerant. An inlet pipe (12) is connected to an upper portion of the casing (11). A discharge pipe (13) is connected to a body portion of the casing (11). An oil reservoir (14) is defined in a lower portion of the casing (11). An oil (a lubricating oil) is retained in the oil reservoir (14).

Motor

The motor (20) is disposed at the axially middle portion of the casing (11). The motor (20) includes a stator (21) and a rotor (22). Each of the stator (21) and the rotor (22) has a cylindrical shape. The stator (21) is fixed to an inner peripheral face of the casing (11). The rotor (22) is rotatably inserted into the stator (21). The drive shaft (25) is fixed to an inner peripheral face of the rotor (22).

Drive Shaft

The drive shaft (25) extends vertically (i.e., axially) in the casing (11). The drive shaft (25) is rotatably supported by a lower bearing (15) and an upper bearing (16). The lower bearing (15) is disposed below the motor (20). The upper bearing (16) is disposed at a center of a protrusion (35) of a housing (31). The drive shaft (25) includes a main shaft (26) and an eccentric shaft (27).

The main shaft (26) extends axially along the casing (11) to pass through the motor (20). An oil pump (28) (an oil transport mechanism) is disposed on a lower end of the main shaft (26). The oil in the oil reservoir (14) is pumped up by the oil pump (28). The oil pumped up by the oil pump (28) flows through an oil feed passage (26*a*) in the drive shaft (25), and then is fed to bearings and sliding portions in the compression mechanism (30).

The eccentric shaft (27) projects upward from an upper end of the main shaft (26). The eccentric shaft (27) has an axis extending eccentrically from an axis of the main shaft (26) by a predetermined distance. The eccentric shaft (27) is smaller in outer diameter than the main shaft (26). A counter weight (29) is disposed around the upper end of the main shaft (26). The counter weight (29) attains a dynamic balance during rotation of the drive shaft (25).

Compression Mechanism

Figure 2:
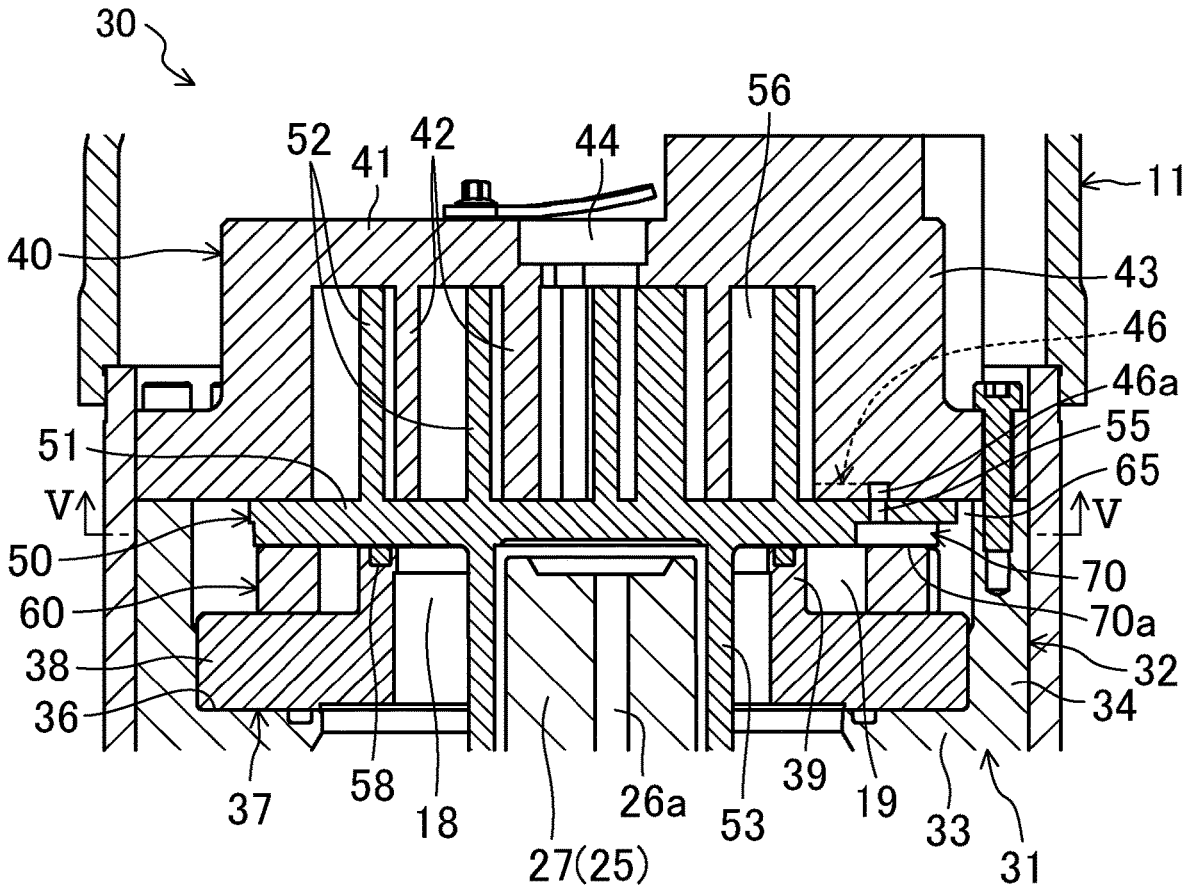
FIG. 2 is an enlarged longitudinal sectional view of main components of a compression mechanism.

The compression mechanism (30) is driven by the motor (20) to compress the refrigerant. The compression mechanism (30) includes a fixed scroll (40) and a movable scroll (50) that mesh with each other, and has a compression chamber (56) defined between the fixed scroll (40) and the movable scroll (50). When the low-pressure refrigerant flows into the compression chamber (56) through the inlet pipe (12), then the low-pressure refrigerant is gradually compressed in the compression chamber (56). The compressed refrigerant is discharged from the compression chamber (56) through a discharge port (44). When the refrigerant is discharged from the compression chamber (56) through the discharge port (44), then the refrigerant flows into a space located below the housing (31). Thereafter, the refrigerant is discharged from the casing (11) through the discharge pipe (13). As illustrated in FIGS. 1 and 2, the compression mechanism (30) includes the housing (31), the fixed scroll (40), the movable scroll (50), and an Oldham ring (60) (an Oldham coupling).

Housing

As illustrated in FIG. 1, the housing (31) includes a first frame (32) fixed to the inner peripheral face of the casing (11), and a second frame (37) disposed above the first frame (32). The first frame (32) has a substantially cylindrical shape through which the drive shaft (25) passes. The first frame (32) includes a base (33), a peripheral wall (34), and the protrusion (35).

The base (33) is disposed around the counter weight (29). The base (33) has a thick tubular shape. The base (33) is fixed at its outer peripheral face to the inner peripheral face of the casing (11). The base (33) has a columnar accommodation space (17) defined therein. The counter weight (29) is accommodated in the columnar accommodation space (17).

The peripheral wall (34) projects upward from an outer peripheral edge of the base (33). The peripheral wall (34) has a tubular shape, and is smaller in thickness than the base (33). The peripheral wall (34) is fixed at its outer peripheral face to the inner peripheral face of the casing (11). The peripheral wall (34) has a frame recess (36) located therein. The second frame (37) is fitted into the frame recess (36).

The protrusion (35) has a substantially tubular shape protruding downward from an inner peripheral edge of the base (33). The upper bearing (16) (e.g., a bearing metal) is disposed in the protrusion (35).

The second frame (37) includes a substantially annular plate that is flat vertically. The second frame (37) is supported by the base (33) of the first frame (32) such that the second frame (37) is fitted to the frame recess (36). The second frame (37) has a space (i.e., a high-pressure chamber (18)) defined therein. A boss (53) of the movable scroll (50) swirls in the high-pressure chamber (18). The high-pressure chamber (18) is located on a back face of the movable-side end plate (51) at a position near a center of the back face. The high-pressure oil in the oil reservoir (14) is fed to the high-pressure chamber (18). In other words, a pressure in the high-pressure chamber (18) corresponds to a discharge pressure from the compression mechanism (30).

As illustrated in FIG. 2, the second frame (37) includes a plate body (38) having a disk shape and an annular projection (39) projecting upward from an inner peripheral edge of the plate body (38). The plate body (38) has in its upper face a pair of fixed-side key grooves (not illustrated). The fixed-side key grooves extend radially, and face each other with a center of the plate body (38) located therebetween. As will be described later with reference to FIG. 4, fixed-side keys (61) of the Oldham ring (60) are respectively fitted to the fixed-side key grooves.

A middle-pressure chamber (19) is defined at an outer periphery of the annular projection (39). The middle-pressure chamber (19) forms a back-pressure chamber defined on the back face of the movable-side end plate (51).

A seal ring (58) is disposed between an upper face of the annular projection (39) and the back face of the movable-side end plate (51). The seal ring (58) serves as an airtight partition between the high-pressure chamber (18) and the middle-pressure chamber (19).

Fixed Scroll

The fixed scroll (40) is disposed on one of axial sides (i.e., an upper side) of the housing (31). The fixed scroll (40) is fastened to the peripheral wall (34) of the housing (31) with a fastening member such as a bolt.

Figure 3:
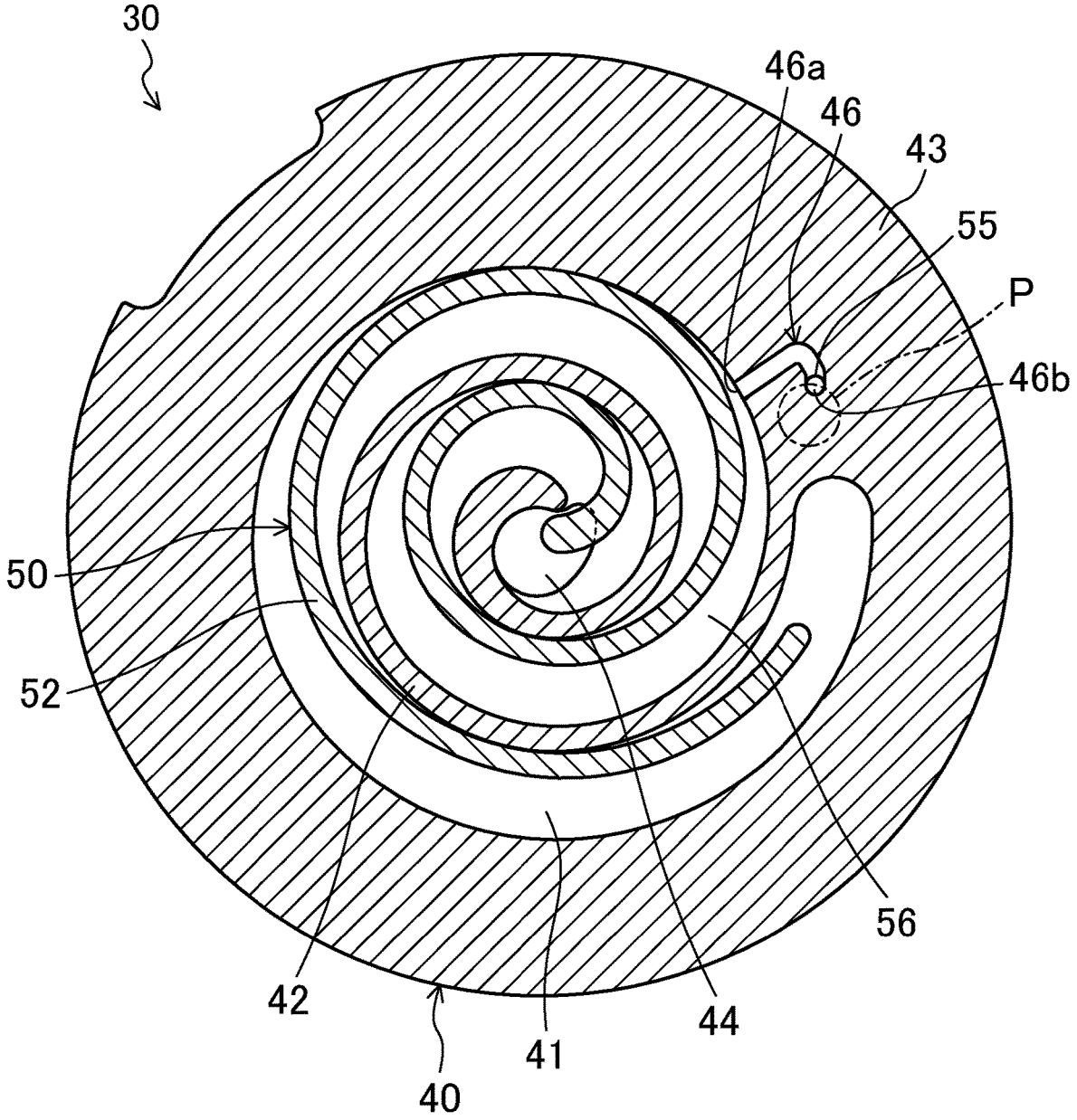
FIG. 3 is a transverse sectional view of main components of the compression mechanism as seen in a direction perpendicular to an axis of the compression mechanism.

As illustrated in FIGS. 2 and 3, the fixed scroll (40) includes a fixed-side end plate (41), a fixed-side wrap (42), and an outer peripheral wall (43). The fixed-side end plate (41) has an almost circular plate shape. The fixed-side wrap (42) has a spiral wall shape in an involute curve. The fixed-side wrap (42) projects from a front face (a lower face in FIG. 2) of the fixed-side end plate (41). The outer peripheral wall (43) surrounds an outer periphery of the fixed-side wrap (42), and projects from the front face of the fixed-side end plate (41). The fixed-side wrap (42) has a distal end face (the lower face in FIG. 2) that is substantially flush with a distal end face of the outer peripheral wall (43).

The outer peripheral wall (43) of the fixed scroll (40) has a suction port (not illustrated). The suction port is connected to an outflow end of the inlet pipe (12). The fixed-side end plate (41) has at its center the discharge port (44) passing through the fixed-side end plate (41).

Movable Scroll

The movable scroll (50) is disposed between the fixed scroll (40) and the housing (31). The movable scroll (50) includes the movable-side end plate (51), a movable-side wrap (52), and the boss (53).

The movable-side end plate (51) has an almost circular plate shape. The movable-side wrap (52) has a spiral wall shape in an involute curve. The movable-side wrap (52) projects from a front face (an upper face in FIG. 2) of the movable-side end plate (51). In this embodiment, the compression mechanism (30) is of an "asymmetric scroll type".

The movable-side wrap (52) of the movable scroll (50) meshes with the fixed-side wrap (42) of the fixed scroll (40). The boss (53) has a cylindrical shape, and projects downward from a center of a back face (a lower face in FIG. 2) of the movable-side end plate (51). The eccentric shaft (27) of the drive shaft (25) is fitted into the boss (53).

Figure 5:
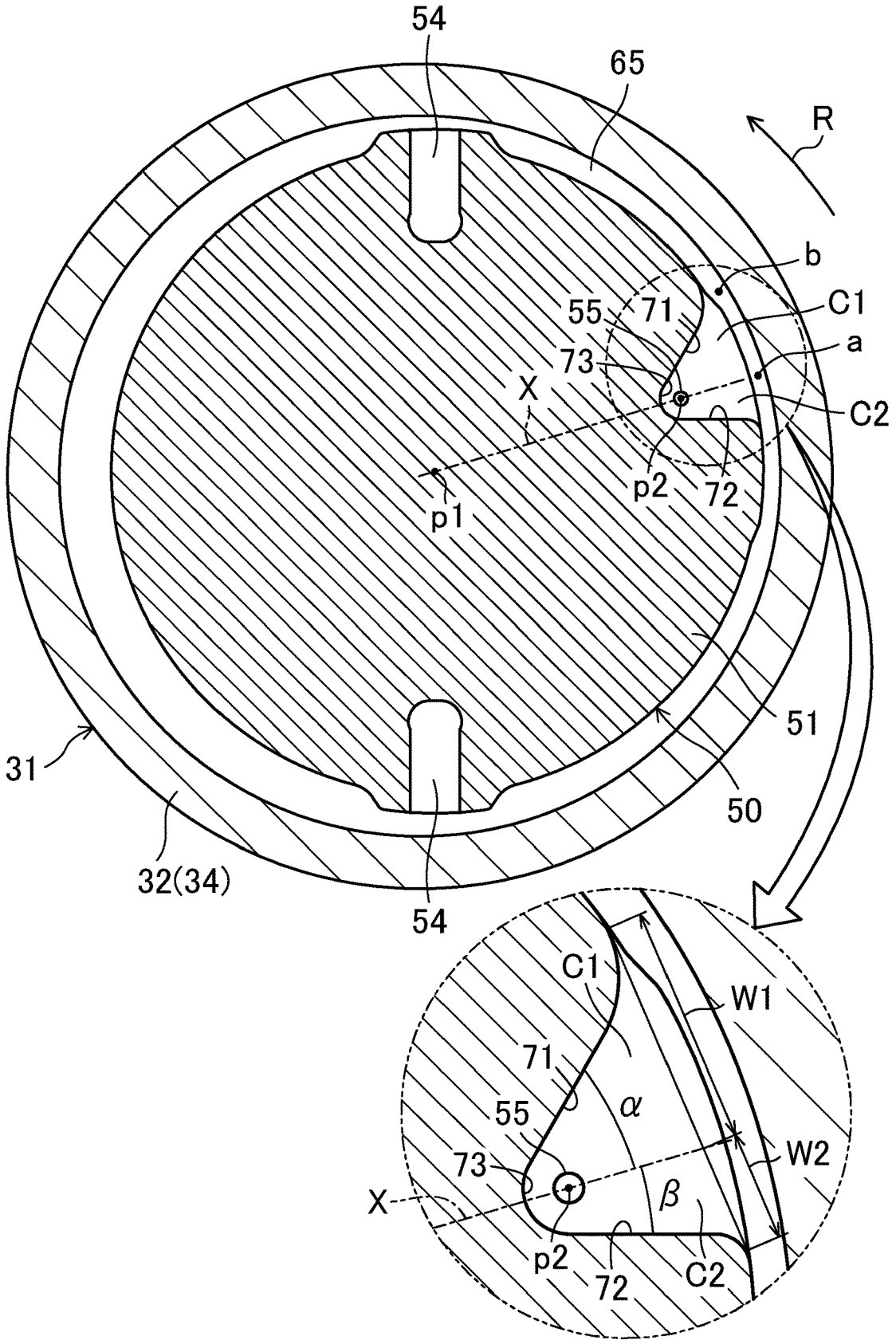
FIG. 5 is a sectional view taken along line V-V in FIG. 2.

As illustrated in FIG. 5, the movable-side end plate (51) has in its back face a pair of movable-side key grooves (54). The movable-side key grooves (54) extend radially, and face each other with a center of the movable-side end plate (51) located therebetween. Movable-side keys (62) of the Oldham ring (60) are respectively fitted to the movable-side key grooves (54).

Oldham Ring

Figure 4:
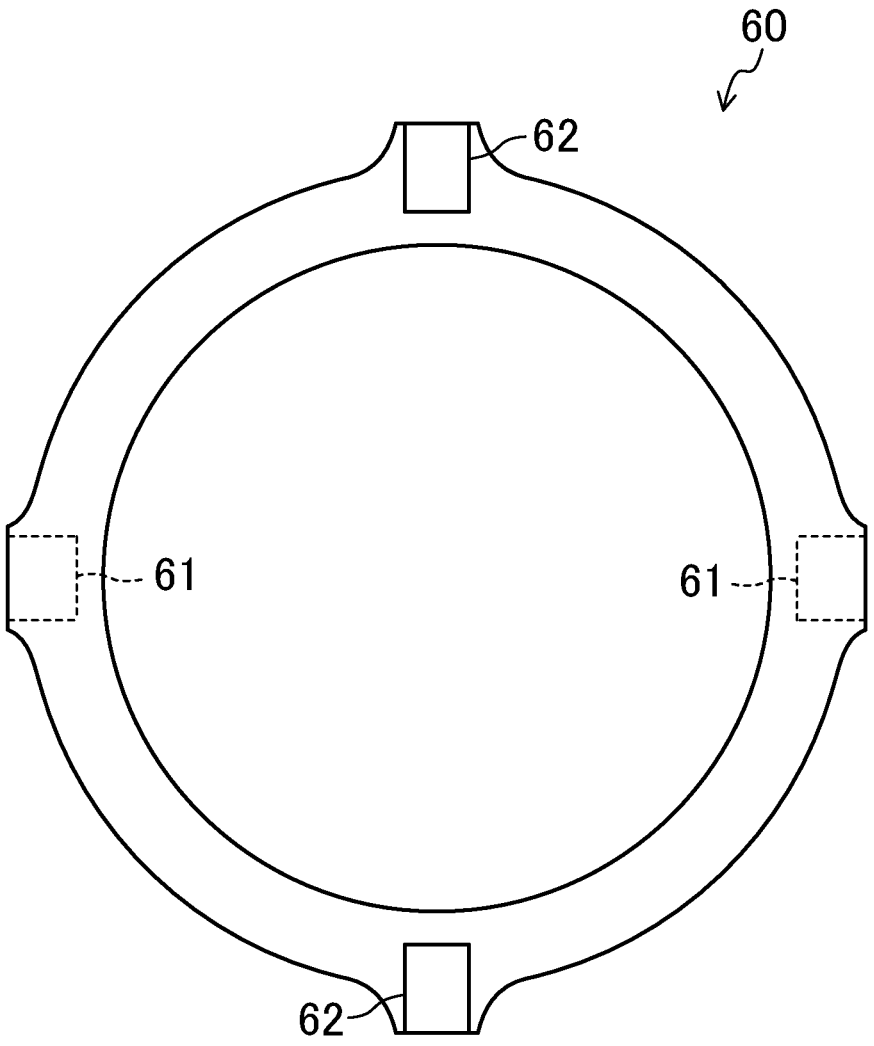
FIG. 4 is a top view of an Oldham ring.

The Oldham ring (60) is disposed between the plate body (38) of the second frame (37) and the movable-side end plate (51). As illustrated in FIG. 4, the Oldham ring (60) has a rectangular ring shape as seen in longitudinal sectional view. The Oldham ring (60) has a substantially fixed thickness over the entire circumference. The Oldham ring (60) has the pair of fixed-side keys (61) and the pair of movable-side keys (62).

The fixed-side keys (61) are disposed on a lower side (i.e., a side facing the housing (31)) of the Oldham ring (60). The fixed-side keys (61) are disposed on a lower face of the Oldham ring (60), and radially face each other. The fixed-side keys (61) are respectively fitted to the fixed-side key grooves (not illustrated). The fixed-side keys (61) are movable back and forth radially (i.e., in a direction of extension of the fixed-side key grooves).

The movable-side keys (62) are disposed on an upper side (i.e., a side facing the movable scroll (50)) of the Oldham ring (60). The movable-side keys (62) are disposed on an upper face of the Oldham ring (60), and radially face each other. The pair of movable-side keys (62) is circumferentially shifted by 90 degrees from the pair of fixed-side keys (61). The movable-side keys (62) are respectively fitted to the movable-side key grooves (54). The movable-side keys (62) are movable back and forth radially (i.e., in a direction of extension of the movable-side key groove (54)).

The Oldham ring (60) moves back and forth radially (i.e., in a first direction) relative to the second frame (37) along the fixed-side keys grooves. The movable scroll (50) moves back and forth in a second direction perpendicular to the first direction relative to the Oldham ring (60) along the movable-side key grooves (54). The configuration of the Oldham ring (60) permits eccentric rotation of the movable scroll (50) driven through the drive shaft (25), about the axis of the drive shaft (25), but restricts the rotation of the movable scroll (50).

Injection Mechanism

The compression mechanism (30) is provided with an injection mechanism for guiding the refrigerant (strictly, the middle-pressure refrigerant) in the compression chamber (56) into the middle-pressure chamber (19) as the back-pressure chamber. As illustrated in FIGS. 2 and 3, the injection mechanism includes a fixed-side passage (46) of the fixed scroll (40) and a movable-side passage (55) of the movable scroll (50).

The fixed-side passage (46) is located on the distal end face (i.e., the lower face) of the outer peripheral wall (43) of the fixed scroll (40). In other words, the fixed-side passage (46) is defined by a groove in a thrust face (a sliding contact face) relative to the movable-side end plate (51). As illustrated in FIG. 3, the fixed-side passage (46) has a hook shape or a substantially "J" shape in plan view. The fixed-side passage (46) has a first end (i.e., an inflow end (46*a*)) that is open at the inner peripheral face of the outer peripheral wall (43) to communicate with the compression chamber (56) in the midstream of compression. The fixed-side passage (46) has a second end (i.e., an outflow end (46*b*)) that faces the movable-side end plate (51).

Figure 6:
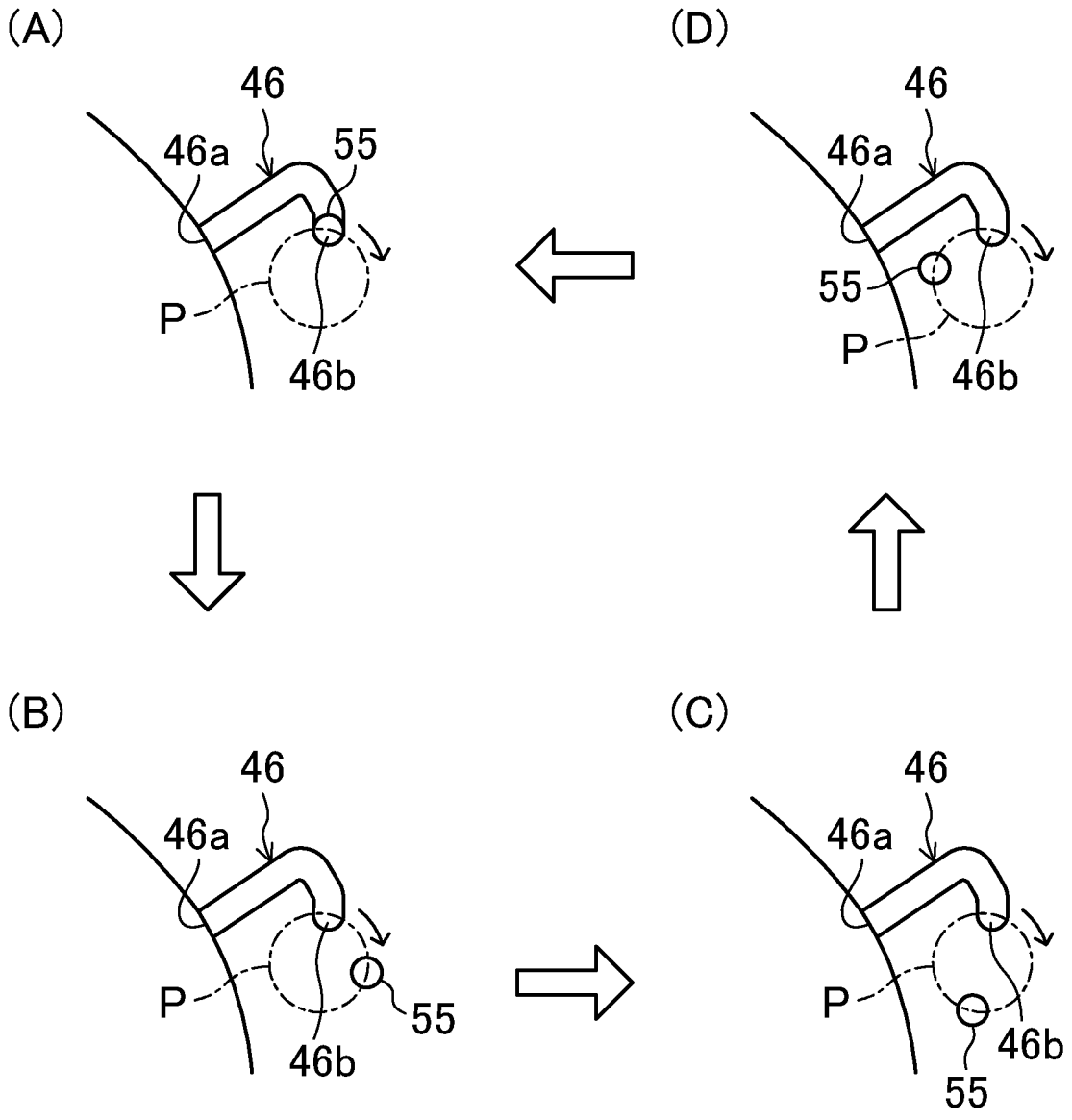
FIG. 6 is a schematic view of a change in position of a movable-side passage along with eccentric rotation of a movable scroll.

The movable-side passage (55) axially passes through the movable-side end plate (51). The movable-side passage (55) has a circular passage section. The movable-side passage (55) has an inflow end (i.e., an upper end) that intermittently communicates with the fixed-side passage (46). The movable-side passage (55) has an outflow end (i.e., a lower end) that is capable of communicating with the middle-pressure chamber (19). As illustrated in FIGS. 3 and 6, the movable-side passage (55) is displaced along a locus P in accordance with the eccentric rotation of the movable scroll (50). The movable-side passage (55) is thus displaced between a communicative position (e.g., a position illustrated in (A) of FIG. 6) at which the movable-side passage (55) communicates with the outflow end (46*b*) of the fixed-side passage (46) and a closed position (e.g., positions illustrated in (B), (C), and (D) of FIG. 6) at which the movable-side passage (55) is separated from the outflow end (46*b*) of the fixed-side passage (46).

As illustrated in FIG. 2, FIG. 3, FIG. 5, and (A) of FIG. 6, when the movable-side passage (55) is at the communicative position, the fixed-side passage (46) communicates with the movable-side passage (55). The movable-side passage (55) communicates with the middle-pressure chamber (19) via an oil drain groove (70) (a communication space) to be described in detail later. As a result, the refrigerant in the compression chamber (56) is guided into the middle-pressure chamber (19), and the pressure in the middle-pressure chamber (19) is kept middle. This configuration thus attains an appropriate pressing force against the fixed-side end plate (41). As illustrated in (B), (C), and (D) of FIG. 6, when the movable-side passage (55) is at the closed position, the fixed-side passage (46) is separated from the movable-side passage (55). In this state, therefore, the refrigerant in the compression chamber (56) is not guided into the middle-pressure chamber (19).

Annular Space

As illustrated in FIG. 2 and FIG. 5 (a sectional view taken along line V-V in FIG. 2), an annular space (65) is defined between the movable-side end plate (51) and the housing (31). Specifically, the annular space (65) is defined between an outer peripheral face of the movable-side end plate (51) and an inner peripheral face of the peripheral wall (34) of the first frame (32). The movable-side end plate (51) swirls in the annular space (65). A radial clearance of the annular space (65) changes in accordance with an eccentric angle position of the movable-side end plate (51). A clearance toward which the movable-side end plate (51) eccentrically rotates (e.g., a clearance near point "a" in FIG. 5) is minimized in the annular space (65).

Issues to be Addressed as to Annular Space

For example, the oil to be fed to the thrust face of the movable-side end plate (51) partially flows into the annular space (65). Therefore, the oil is present in the annular space (65). According to the related art, when the movable scroll (50) eccentrically rotates, the oil in the annular space (65) is pressed against the outer peripheral face of the movable-side end plate (51). This results in increased stirring loss of the oil and increased power loss of the motor.

Configuration of Communication Space (Oil Drain Groove)

In order to address the issue, this embodiment employs the oil drain groove (70) as a recess in the movable-side end plate (51). The oil drain groove (70) defines a communication space through which the movable-side passage (55) communicates with the annular space (65).

As illustrated in FIGS. 2 and 5, the oil drain groove (70) is located in the back face of the movable-side end plate (51). The oil drain groove (70) radially extends from the outer peripheral face of the movable-side end plate (51) toward the movable-side passage (55). In other words, the oil drain groove (70) is located in a region that axially overlaps the movable-side passage (55). As illustrated in FIG. 2, the oil drain groove (70) has an open face (70*a*) (a lower face) almost entirely closed by the upper face of the Oldham ring (60). The Oldham ring (60) serves as a rotation preventive mechanism for the movable scroll (50) and a closing member closing the oil drain groove (70). The Oldham ring (60) may be disposed to close at least a part of the open face (70*a*) of the oil drain groove (70). Alternatively, the Oldham ring (60) may be disposed to close the entire open face (70*a*) of the oil drain groove (70).

The oil drain groove (70) according to this embodiment has an inner wall including a first face (71), a second face (72), and a curved face (73). The first face (71) is located forward in a direction indicated by arrow R in FIG. 5, that is, in the direction of eccentric rotation of the movable scroll (50). The first face (71) has a flat shape that is substantially perpendicular to the back face of the movable-side end plate (51). The first face (71) extends almost linearly. The second face (72) is located rearward in the direction of eccentric rotation of the movable scroll (50). The second face (72) has a flat shape that is substantially perpendicular to the back face of the movable-side end plate (51). The second face (72) extends almost linearly. The curved face (73) is located radially inward with respect to the movable-side passage (55), and has both ends continuously leading to the first face (71) and the second face (72), respectively. The curved face (73) is curved along a peripheral edge of an open end of the movable-side passage (55).

The oil drain groove (70) has a substantially fan shape in plan view, that is, as seen in a direction perpendicular to an axis of the movable-side end plate (51). Specifically, the oil drain groove (70) has a circumferential width that gradually increases radially outward. The circumferential width of the oil drain groove (70) corresponds to a distance between the first face (71) and the second face (72).

The oil drain groove (70) includes a first communication portion (C1) and a second communication portion (C2). The first communication portion (C1) of the oil drain groove (70) is located forward of the movable-side passage (55) in the direction of eccentric rotation. The second communication portion (C2) of the oil drain groove (70) is located rearward of the movable-side passage (55) in the direction of eccentric rotation. As illustrated in FIG. 5, more strictly, a reference plane X represents a virtual plane passing a center p1 of the movable-side passage (55) and an axis p2 of the movable-side end plate (51) in plan view, that is, as seen in the direction perpendicular to the axis of the movable-side end plate (51). In this case, the first communication portion (C1) can be regarded as a space defined by the reference plane X and the first face (71). On the other hand, the second communication portion (C2) can be regarded as a space defined by the reference plane X and the second face (72).

In the oil drain groove (70) according to this embodiment, a circumferential width W1 of an opening (first opening) in the first communication portion (C1), the first opening being open toward the annular space (65), is larger than a circumferential width W2 of an opening (second opening) in the second communication portion (C2), the second opening being open toward the annular space (65). Also in the oil drain groove (70) according to this embodiment, an angle $\alpha$ formed by the reference plane X and the first face (71) is larger than an angle $\beta$ formed by the reference plane X and the second face (72).

As illustrated in FIG. 2, the oil drain groove (70) has a height that is equal to or slightly greater than about a half of the thickness of the movable-side end plate (51).

Functional Operation of Communication Space

During the operation of the compressor (10), the movable-side end plate (51) eccentrically rotates in the annular space (65). When the oil in the annular space (65) is pressed against the outer peripheral face of the movable-side end plate (51) that eccentrically rotates, then the oil in the annular space (65) is guided into the oil drain groove (70).

When the movable-side end plate (51) is at the position illustrated in FIGS. 2 and 5, the movable-side passage (55) overlaps the outflow end (46*b*) of the fixed-side passage (46). Therefore, the oil in the oil drain groove (70) flows into the movable-side passage (55) at the communicative position. The oil flows backward through the fixed-side passage (46), and then flows into the compression chamber (56). This configuration rapidly reduces the internal pressure in the annular space (65). This configuration also suppresses lubrication failure since the lubricating oil returns to the sliding portions in the compression chamber (56).

When the movable-side end plate (51) is at the position illustrated in FIGS. 2 and 5, a clearance of the annular space (65) on a radially outward extension from the movable-side passage (55), that is, a clearance located near point "a" in FIG. 5 becomes narrower to increase the oil pressure at the position near point "a". This configuration therefore enables guidance of the oil into oil drain groove (70) using the oil pressure at the position near point "a", and suppresses an increase in the oil pressure at the position near point "a".

Strictly, when the movable-side end plate (51) eccentrically rotates, the oil located slightly forward in the rotation of eccentric rotation is pressed against the movable-side end plate (51) in the annular space (65). In the example illustrated in FIG. 5, therefore, the oil pressure at a position slightly forward of point "a" (e.g., the oil pressure at a position near point "b" in FIG. 5) is apt to further increase.

In contrast to this, according to this embodiment, the first communication portion (C1) is located forward of the movable-side passage (55) in the direction of eccentric rotation. In addition, the width W1 of the opening in the first communication portion (C1) is larger than the width W2 of the opening in the second communication portion (C2). This configuration therefore enables reliable guidance of the oil into oil drain groove (70) using the oil pressure at the position near point "b", and suppresses an increase in the oil pressure.

The guidance of the high-pressure oil (hereinafter, also referred to as an oil guiding operation) starts at the time when at least the movable-side passage (55) communicates with the fixed-side passage (46). Thereafter, when the internal pressure in the oil drain groove (70) decreases in the state in which the movable-side passage (55) continuously communicates with the fixed-side passage (46), the refrigerant in the compression chamber (56) flows through the fixed-side passage (46) and the movable-side passage (55) in the forward direction. This refrigerant is then fed to the middle-pressure chamber (19). In other words, when the movable-side passage (55) communicates with the fixed-side passage (46), the scroll compressor performs the oil guiding operation, and then performs an injection operation of guiding the refrigerant into the middle-pressure chamber (19).

Advantageous Effects of Embodiment

According to this embodiment, the movable-side end plate (51) of the movable scroll (50) has the oil drain groove (70) (the communication space) through which the movable-side passage (55) communicates with the annular space (65).

With this configuration, the oil in the annular space (65) is fed to the compression chamber (56) via the oil drain groove (70) and the movable-side passage (55). This configuration thus reduces the amount of oil in the annular space (65). As a result, this configuration suppresses an increase in stirring loss of the oil and an increase in power loss.

Since the annular space (65) communicates with the oil drain groove (70), the substantial volume of the annular space (65) increases. This configuration therefore reduces the oil pressure in the annular space (65).

Since the annular space (65) communicates with the middle-pressure chamber (19) via the oil drain groove (70), the substantial volume of the annular space (65) increases. In addition, the oil in the annular space (65) is fed to the middle-pressure chamber (19). This configuration therefore reduces the oil pressure in the annular space (65).

The oil guided into the oil drain groove (70) is fed to the compression chamber (56) via the movable-side passage (55) and the fixed-side passage (46). Therefore, the oil in the annular space (65) is used for lubricating the sliding portions in the compression chamber (56) and sealing the clearance.

The movable-side passage (55) and the fixed-side passage (46) serve as a passage for draining an oil and a passage in the injection mechanism. This configuration therefore simplifies a structure of and processing for the compression mechanism (30).

According to this embodiment, the communication space is defined by the recess (the oil drain groove (70)) in the back face of the movable-side end plate (51). In a case where a hole is bored in the movable-side end plate (51), it is necessary to thicken the movable-side end plate (51), resulting in axial upsizing of the compression mechanism (30) and increased power for the compression mechanism (30). However, the oil drain groove (70) as the recess in the back face of the movable-side end plate (51) eliminates the necessity of thickening the movable-side end plate (51). This configuration also improves the processability.

As illustrated in FIG. 2, according to this embodiment, the Oldham ring (the closing member (60)) closes at least a part of the open face (70*a*) of the oil drain groove (70). With this configuration, the oil guided into the oil drain groove (70) is reliably fed to the movable-side passage (55). The Oldham ring (60) serves as the rotation preventive mechanism and the closing member. This configuration therefore achieves a low parts count.

As illustrated in FIG. 5, according to this embodiment, the oil drain groove (70) radially extends, and communicates with the movable-side passage (55). This configuration minimizes the length of the oil drain groove (70), and allows the movable-side passage (55) to communicate with the annular space (65). In addition, the oil in the smallest clearance (near point "a" in FIG. 5) of the annular space (65) is reliably guided into the movable-side passage (55). This configuration also improves the processability.

According to this embodiment, the circumferential width W1 of the opening in the first communication portion (C1), the opening being open toward the annular space (65), is larger than the circumferential width W2 of the opening in the second communication portion (C2), the opening being open toward the annular space (65). With this configuration, the oil is reliably guided into the oil drain groove (70) by use of the oil pressure at the clearance (near point "b" in FIG. 5) located forward of the movable-side passage (55) (strictly, the reference plane X).

According to this embodiment, the oil drain groove (70) has the shape circumferentially enlarged radially outward. This configuration increases the width of the oil drain groove (70) that is open toward the annular space (65), and therefore facilitates the guidance of the oil in the annular space (65) into the communication space (70, 76).

Modifications of Embodiment

The foregoing embodiment may be modified as below.

Modification 1

Figure 7:
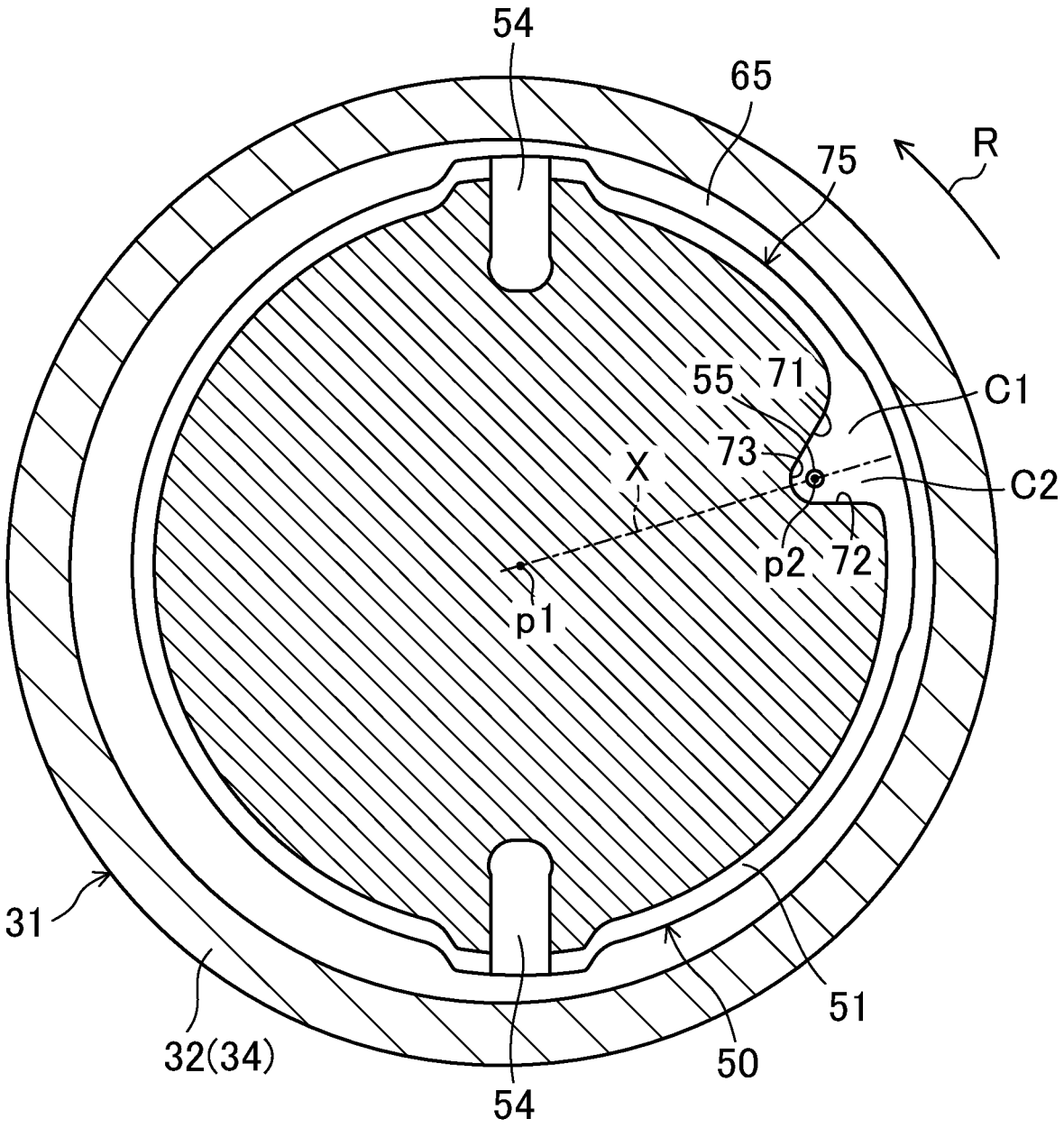
FIG. 7 is a sectional view equivalent to FIG. 5, which illustrates Modification 1.

According to Modification 1 illustrated in FIG. 7, the movable-side end plate (51) described in the foregoing embodiment has in its outer peripheral face a groove (an enlarged groove (75)) communicating with the oil drain groove (70). According to Modification 1, the enlarged groove (75) circumferentially extends along the outer peripheral edge of the back face of the movable-side end plate (51). According to Modification 1, the enlarged groove (75) extends over the entire circumference of the movable-side end plate (51).

According to Modification 1, the oil in the annular space (65) is guided into the oil drain groove (70) while being captured in the enlarged groove (75). This configuration therefore reduces the amount of the oil in the annular space (65). This configuration also reduces the oil pressure in the annular space (65) since the enlarged groove (75) increases the substantial volume of the annular space (65).

Modification 2

Figure 8:
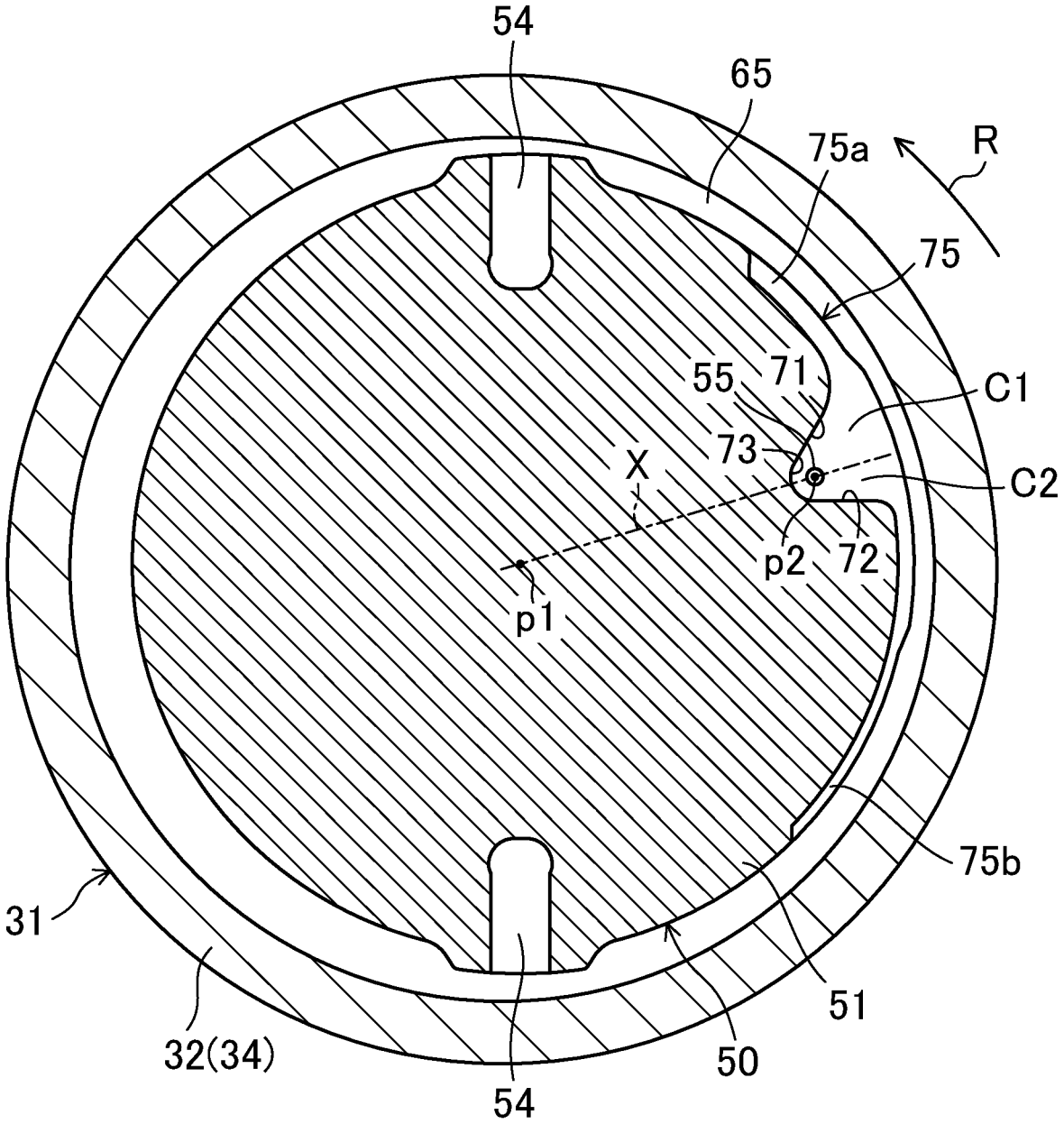
FIG. 8 is a sectional view equivalent to FIG. 5, which illustrates Modification 2.

According to Modification 2 illustrated in FIG. 8, the enlarged groove (75) extends over a part of the entire circumference of the movable-side end plate (51). According to Modification 2, specifically, the enlarged groove (75) includes a front groove portion (75*a*) extending forward from the oil drain groove (70) in the direction of eccentric rotation and a rear groove portion (75*b*) extending rearward from the oil drain groove (70) in the direction of eccentric rotation. The front groove portion (75*a*) is longer in circumferential length than the rear groove portion (75*b*).

According to Modification 2, the oil is guided into the front groove portion (75*a*) by use of the oil pressure at the clearance of the annular space (65), the clearance being located forward of the movable-side passage (55) (strictly, located forward of the reference plane X).

Modification 3

Figure 9:
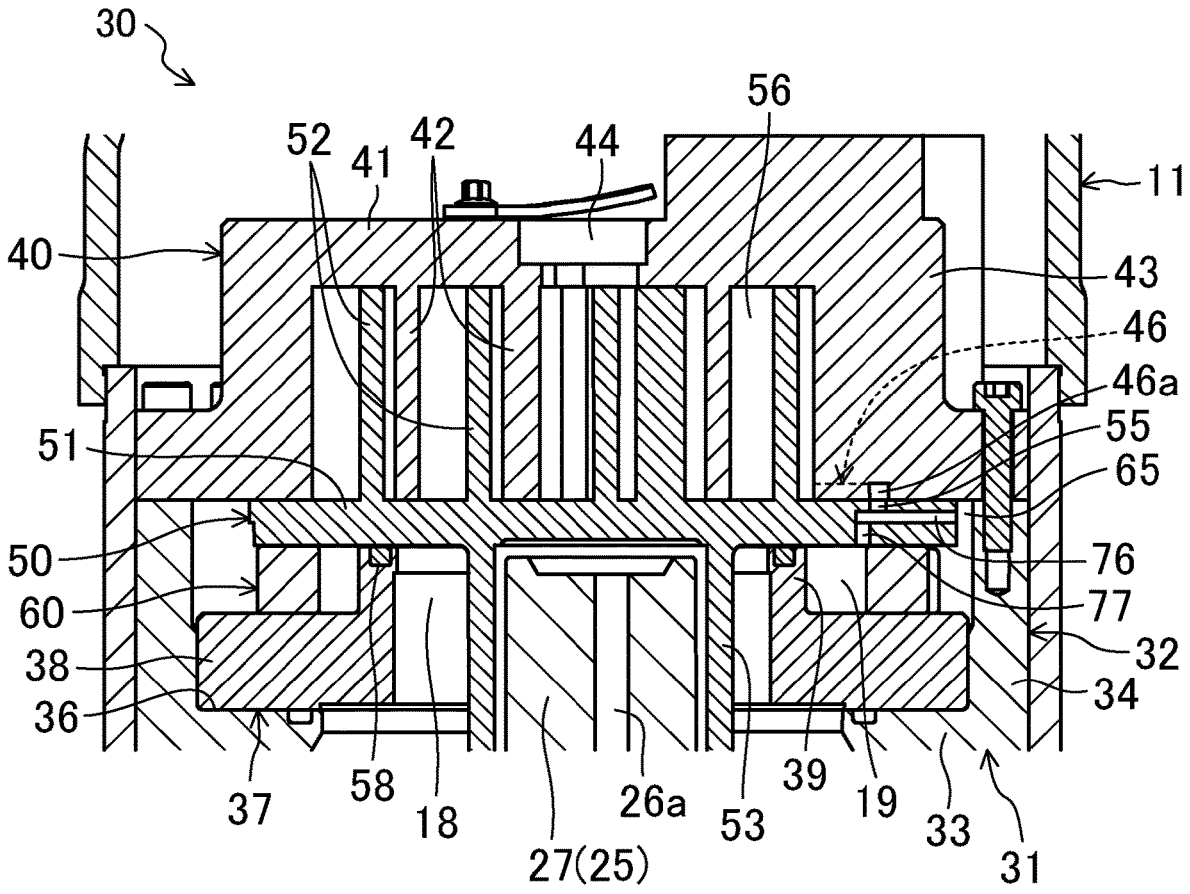
FIG. 9 is a longitudinal sectional view equivalent to FIG. 2, which illustrates Modification 3.

According to Modification 3 illustrated in FIG. 9, the communication space is defined by an oil drain hole (76) in the movable-side end plate (51). The oil drain hole (76) defines a laterally elongated passage that radially extends from the outer peripheral face of the movable-side end plate (51) toward the movable-side passage (55). According to Modification 3, the injection mechanism includes a relay path (77) (a vertical hole) through which the oil drain hole (76) communicates with the middle-pressure chamber (19). In other words, the movable-side passage (55) communicates with the middle-pressure chamber (19) via the oil drain hole (76) and the relay path (77).

During the injection operation, the refrigerant in the compression chamber (56) flows through the fixed-side passage (46), the movable-side passage (55), the oil drain hole (76), and the relay path (77) in sequence, and then is guided into the middle-pressure chamber (19). During the oil guiding operation, the oil in the annular space (65) is guided into the compression chamber (56) via the oil drain hole (76), the movable-side passage (55), and the fixed-side passage (46).

In Modification 3, the movable-side end plate (51) may have in its outer peripheral face an enlarged groove (75) communicating with the oil drain hole (76). The enlarged groove (75) may extend over the entire circumference of the movable-side end plate (51) in a manner similar to that described in Modification 1. Alternatively, the enlarged groove (75) may extend over a part of the entire circumference of the movable-side end plate (51) in a manner similar to that described in Modification 2. In this case, preferably, a front groove portion (75*a*) is longer in circumferential length than a rear groove portion (75*b*) in a manner similar to that described in Modification 2.

OTHER EMBODIMENTS

The communication space (70, 76) does not necessarily extend in the radial direction, and may have any shape as long as the annular space (65) communicates with the movable-side passage (55) through the communication space (70, 76).

The back-pressure chamber (19) may be, for example, a high-pressure chamber into which a high-pressure refrigerant is guided, rather than the middle-pressure chamber.

In addition to the Oldham ring (60), the closing member may be any component.

The foregoing embodiment and modifications are preferable examples in nature, and are not intended to limit the scope, application or use of the present invention. While the embodiment and modifications have been described herein above, it is to be appreciated that various changes in form and detail may be made without departing from the spirit and scope presently or hereafter claimed. In addition, the foregoing embodiment and modifications may be appropriately combined or substituted as long as its combination or substitution does not impair the functions of the present disclosure. The foregoing ordinal numbers such as "first", "second", and "third" are merely used for distinguishing the elements designated with the ordinal numbers, and are not intended to limit the number and order of the elements. As described above, the present disclosure is useful for a scroll compressor.

The invention claimed is:

1. A scroll compressor comprising:

a compression mechanism including a movable scroll and a fixed scroll and a compression chamber defined between the movable scroll and the fixed scroll, the compression mechanism having a back-pressure chamber defined on a back face of an end plate of the movable scroll, the compression mechanism having an annular space defined at an outer periphery of the end plate of the movable scroll, the movable scroll having a movable-side passage through which the compression chamber intermittently communicates with the back-pressure chamber in accordance with eccentric rotation of the movable scroll, the end plate of the movable scroll having a communication space through which the movable-side passage communicates with the annular space, the communication space including a first communication portion located forward of the movable-side passage in a direction of eccentric rotation, and a second communication portion located rearward of the movable-side passage in the direction of eccentric rotation, and a first circumferential width of a first opening in the first communication portion being larger than a second circumferential width of a second opening in the second communication portion, the first opening being open toward to the annular space, and the second opening being open toward the annular space.

2. The scroll compressor according to claim 1, wherein the communication space includes a recess in the back face of the end plate of the movable scroll.

3. The scroll compressor according to claim 2, further comprising:

a closing member closing at least a part of an open face of the recess.

4. The scroll compressor according to claim 3, wherein the closing member includes an Oldham coupling.

5. The scroll compressor according to claim 4, wherein the communication space radially extends to communicate with the movable-side passage.

6. The scroll compressor according to claim 4, wherein the communication space has a shape circumferentially enlarged radially outward.

7. The scroll compressor according to claim 4, wherein the end plate of the movable scroll has, in an outer peripheral face thereof, a groove circumferentially extending to communicate with the communication space.

8. The scroll compressor according to claim 3, wherein the communication space radially extends to communicate with the movable-side passage.

9. The scroll compressor according to claim 3, wherein the communication space has a shape circumferentially enlarged radially outward.

10. The scroll compressor according to claim 3, wherein the end plate of the movable scroll has, in an outer peripheral face thereof, a groove circumferentially extending to communicate with the communication space.

11. The scroll compressor according to claim 2, wherein the communication space radially extends to communicate with the movable-side passage.

12. The scroll compressor according to claim 2, wherein the communication space has a shape circumferentially enlarged radially outward.

13. The scroll compressor according to claim 2, wherein the end plate of the movable scroll has, in an outer peripheral face thereof, a groove circumferentially extending to communicate with the communication space.

14. The scroll compressor according to claim 1, wherein the communication space radially extends to communicate with the movable-side passage.

15. The scroll compressor according to claim 14, wherein the communication space has a shape circumferentially enlarged radially outward.

16. The scroll compressor according to claim 14, wherein the end plate of the movable scroll has, in an outer peripheral face thereof, a groove circumferentially extending to communicate with the communication space.

17. The scroll compressor according to claim 1, wherein the communication space has a shape circumferentially enlarged radially outward.

18. The scroll compressor according to claim 1, wherein the end plate of the movable scroll has, in an outer peripheral face thereof, a groove circumferentially extending to communicate with the communication space.

19. The scroll compressor according to claim 18, wherein the groove extends at least forward from the communication space in the direction of eccentric rotation.

20. The scroll compressor according to claim 1, wherein when the movable scroll is at an eccentric angle position, the movable-side passage communicates with the compression chamber, and the communication space is located nearest to an inner peripheral face of the annular space.

* * * * *